United States Patent [19]

Coulter et al.

[11] 4,337,544

[45] Jul. 6, 1982

[54] SPORT FISHING BOAT

[76] Inventors: Nancey J. Coulter; Lawrence Coulter, both of P.O. Box 6, Boley, Okla. 74829

[21] Appl. No.: 189,814

[22] Filed: Sep. 22, 1980

[51] Int. Cl.[3] ..... B63B 3/20; B63B 5/24

[52] U.S. Cl. ..... 114/357; 114/56; 114/363

[58] Field of Search ..... 9/6 P, 6 R, 6 W, 6 M, 9/3, 1.1, 7; 114/56, 65 R, 68, 69, 288

[56] References Cited

U.S. PATENT DOCUMENTS

| | | | |
|---|---|---|---|
| 2,866,985 | 1/1959 | Blackmore | 9/6 P |
| 3,032,785 | 5/1962 | Ward et al. | 9/6 M |
| 3,051,115 | 8/1962 | Canazzi | 114/56 |
| 3,599,257 | 8/1971 | Erickson | 9/6 P |
| 3,648,310 | 3/1972 | Butler | 9/6 P |
| 3,848,921 | 11/1974 | Rhodes | 9/7 X |

FOREIGN PATENT DOCUMENTS

| | | | |
|---|---|---|---|
| 1521209 | 4/1968 | France | 9/6 P |
| 931244 | 7/1963 | United Kingdom | 9/6 P |

*Primary Examiner*—Sherman D. Basinger
*Attorney, Agent, or Firm*—William R. Laney

[57] ABSTRACT

A sport fishing boat having a generally rectangular overall top view configuration and having a pair of fiber glass hulls, including an inner hull and an outer hull. The inner and outer hulls are spaced from each other at opposite sides of the boat to accommodate flotation material, and the inner hull is spaced upwardly from the outer hull at a location immediately abaft the bow to form a downwardly and rearwardly inclined ramp and a forward chamber for flotation material. The inner hull is also spaced upwardly from the outer hull at two laterally aligned locations forward of the stern of the boat to form a pair of after flotation material chambers. Three transversely spaced keel ribs extend from the stern toward the bow on the underside of the outer hull, and a pair of stationary recesses are indented in the bottom of the outer hull and project from opposite sides of the boat toward the centerline thereof at a location spaced aft of the bow.

12 Claims, 10 Drawing Figures

SPORT FISHING BOAT

BACKGROUND OF THE INVENTION

1. Field of the Invention

This invention relates to boats, and particularly to small fresh water sport fishing boats.

2. Brief Description of the Prior Art

Small boats for use by fishermen for fresh water game fishing take many forms. So-called bass boats are usually quite small, carrying from two to four persons and having a relatively shallow draft to permit the boat to be propelled into shallow coves and over submerged treetops and brush located near the surface. It is necessary, of course, to provide adequate room in such boats to accommodate fishing tackle and the like. To retain the desired criteria of shallow draft and adequate room for gear, such boats generally have a relatively broad beam width. It is also generally desirable to have relatively little freeboard in such boats in order to permit the fisherman to easily release snagged lures and retrieve hooked fish.

The shallow draft and low freeboard provide an amplified concern for the stability of the boat in choppy or rough water, and also of stably accommodating the frequent movements of the fishermen toward one side of the boat or the other. Capsizing and swamping does occur from time to time. In this event, the boat will generally having flotation characteristics such that it will not sink, but will remain afloat with at least some part of the boat projecting above the surface of the water.

One attempt to achieve stability in a two-man small sport boat of this type is shown in U.S. Design Pat. No. 229,719 where a twin-hulled, twin-keeled fiber glass boat is illustrated.

A broad-beamed boat having a wide and long stabilizing channel extending from bow to stern of the boat on the lower side of the hull is illustrated in U.S. Design Pat. No. 206,503.

Efforts to stabilize and improve the swamp flotation characteristics of boats by selective placement of buoyant flotation material between nested double hulls are represented by the boats shown in Blackmore U.S. Pat. No. 2,866,985; Waring U.S. Pat. No. 2,381,631 and Moore et al. U.S. Pat. No. 3,831,212.

BRIEF DESCRIPTION OF THE PRESENT INVENTION

The present invention provides a small boat of low freeboard and shallow draft which is very stable, yet which, if capsized or swamped, nevertheless continues to float evenly in the water with portions of the boat at the bow, stern and gunwales projecting above the water.

Broadly described, the boat of the invention comprises a pair of internesting hulls which define flotation material spaces along the gunwales from bow to stern, and which further define a pair of triangular flotation material spaces at opposite sides of the boat center line and adjacent the stern of the boat. The inner and outer hulls are preferably formed of fiber glass, and the flotation material is preferably styrofoam.

The inner hull slopes downwardly and aft from the bow of the boat to form both a foot ramp for a fisherman seated near the bow, and a top closure for a forward flotation material chamber. Immediately forward of the stern of the boat, the inner and outer hulls are also spaced from each other to define a pair of transversely spaced flotation material chambers of generally triangular cross-sectional configuration. For purposes of stabilizing the boat, three substantially parallel protuberant ribs are formed on the underside of the outer hull and extend from the bow to the stern of the boat. Also, a pair of stationary recesses are indented in the bottom of the outer hull and project from opposite sides of the boat toward the centerline thereof at a location spaced aft of the bow.

An important object of the present invention is to provide a small stable boat of light weight which can accommodate two fishermen, and which is characterized in having a shallow draft and a relatively low freeboard.

Another object of the present invention is to provide a small fishing boat of relatively broad beam and shallow draft which is of double-hulled construction with flotation material disposed in spaces between the hulls so that the boat will float evenly in the water even when completely swamped.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
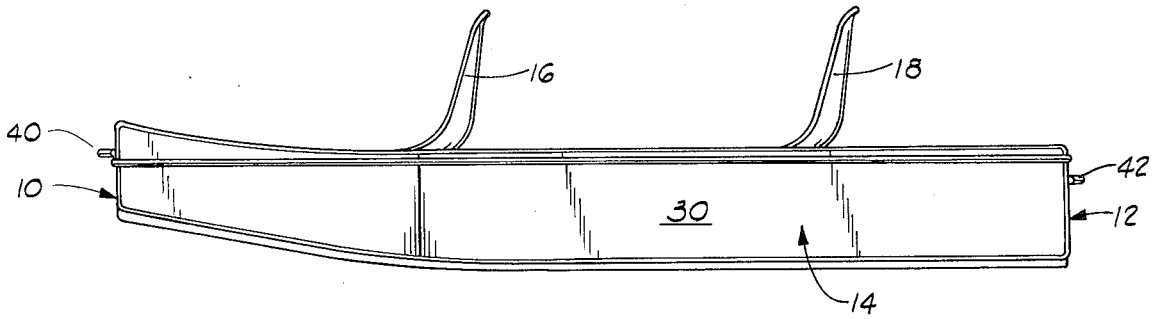
FIG. 1 is a side elevation view of a boat constructed in accordance with the present invention.

Referring initially to FIG. 1 of the drawings, the port side of the boat is illustrated in elevation. The boat includes, in general, a bow 10, a stern 12, a port side 14, and a starboard side having the same appearance as the port side. The boat is provided with a pair of seats 16 and 18 mounted within the boat on the centerline thereof, and pivotally supported on identically constructed pedestals 20 to facilitate swiveling movement of the seats.

Figure 2:
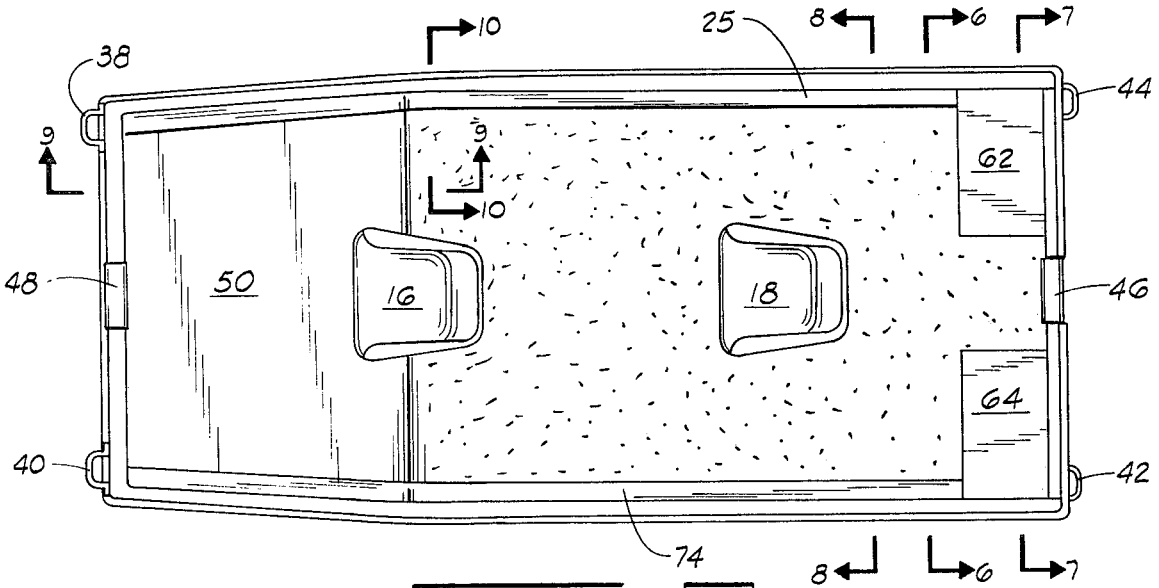
FIG. 2 is a plan view of the boat shown in FIG. 1.

The boat is dimensioned to have a beam-to-length proportion as illustrated in FIG. 2 of the drawings. Thus, the overall width of the boat is slightly less than one-half of the boat's length.

Figure 7:
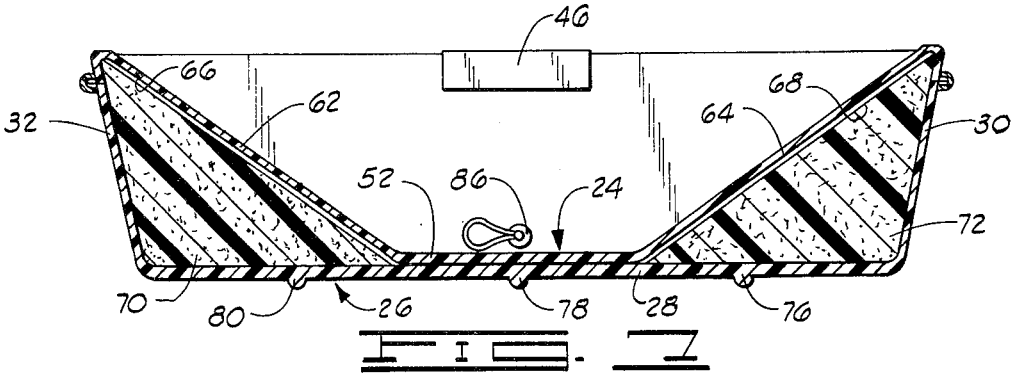
FIG. 7 is a sectional view taken along line 7—7 of FIG. 2.
Figure 8:
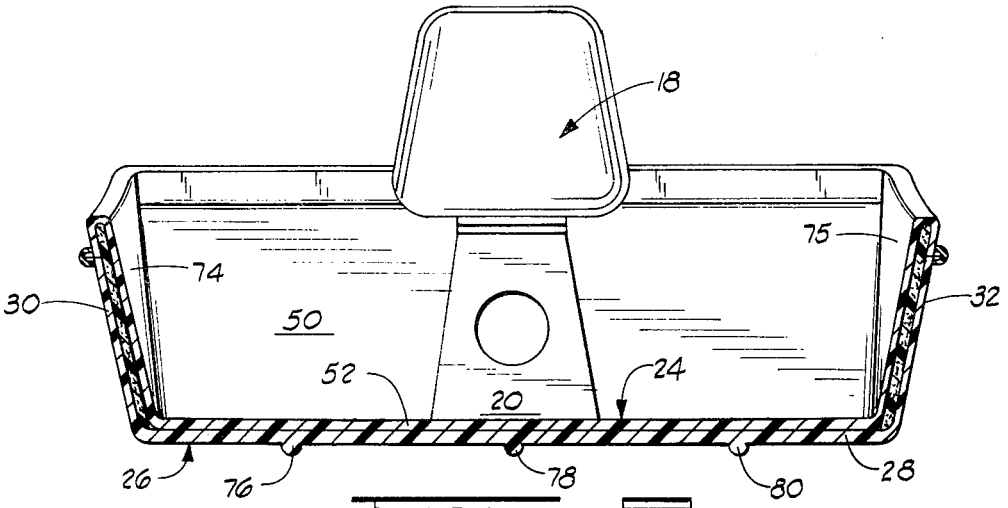
FIG. 8 is a sectional view taken along line 8—8 of FIG. 2.
Figure 9:
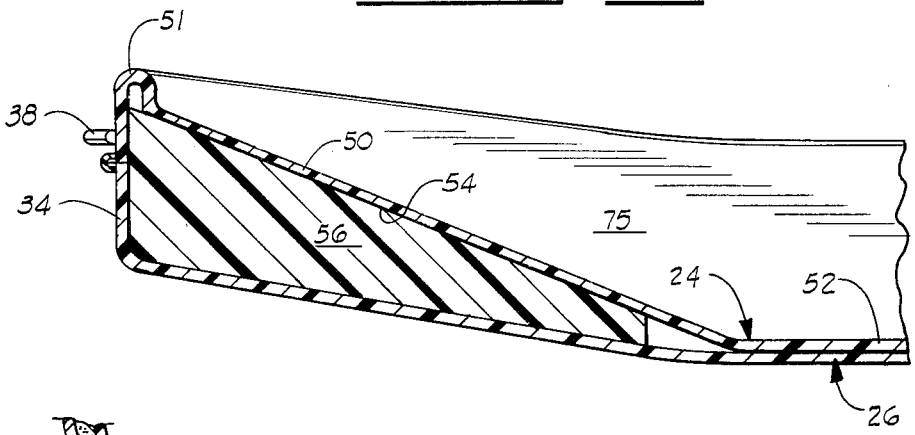
FIG. 9 is a sectional view taken along line 9—9 of FIG. 2.

The boat is constructed by mating a pair of internesting, generally complementarily shaped fiber glass hulls. The two fiber glass hulls which are thus utilized include an inner hull 24 and an outer hull 26 as shown in FIGS. 7, 8 and 9. The configuration of the outer silhouette or contour of the boat yields a generally trapezoidal transverse cross-sectional configuration. Thus, as shown in FIG. 8 of the drawings, the outer hull 26 has a generally trapezoidal configuration in cross-section, and thus includes a bottom 28 and two side or gunwale plates, 30 and 32, which project upwardly and outwardly from the bottom 28. The outer hull 26 also includes a vertically extending, generally rectangular bow transom plate 34 and a generally rectangular vertically extending stern transom plate 36. Mounted to the transom plate 34 at the upper side thereof are a pair of mooring cleats 38 and 40. Similarly, a pair of mooring cleats 42 and 44 are secured to the stern transom plate 36.

Figure 3:
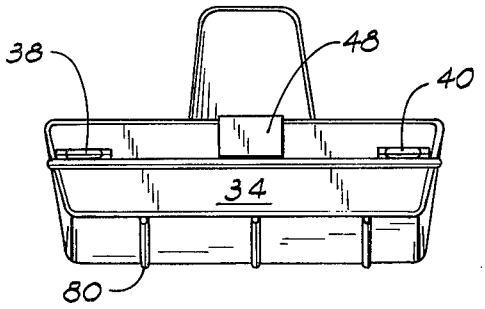
FIG. 3 is a front elevation view of the boat as it appears when viewed from ahead of the boat.
Figure 4:
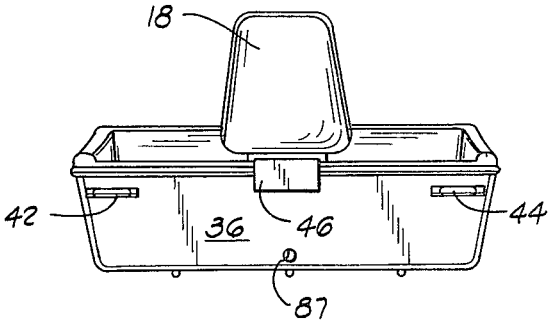
FIG. 4 is a rear elevation view of the boat as it appears when viewed from the stern.

At the center of the upper edge of the stern transom plate 36, a metal motor mounting plate 46 is secured over the top portion of this transom plate to protect the fiber glass from the clamps used to mount an outboard motor on the transom plate. The metal motor mounting plate 46 is of generally U-shaped configuration with an inner leg which passes over and bears against the inboard side of the inner hull 24 as shown in FIG. 7. In similar fashion, a metal trolling motor mounting plate 48 is secured over the upper edge of the bow transom plate 34 as shown in FIG. 3.

The inner hull 24 of the boat is detailed in its shape somewhat differently from the outer hull as best illustrated in FIGS. 7 and 9. Thus, the bow portion of the inner hull 24 includes a downwardly and rearwardly sloping ramp plate 50 which has a turned over upper edge portion 51 at its forward end which forms a lip and joins the bow transom plate 34 forming a part of the outer hull 26. The ramp plate 50 extends downwardly and rearwardly until it merges with an integrally formed bottom 52 of the inner hull 24. By reason of this configuration of the inner hull 24, a space or chamber 54 is formed between the forward portion of the inner hull and the forward portion of the outer hull and this chamber accommodates a large body 56 of flotation material which is preferably polystyrene.

At the rear of the boat, the inner hull 24 has a pair of vertically extending triangular plates 58 and 60 which project upwardly from, and are formed integrally with, the bottom 52 of the inner hull. The triangular plates 58 and 60 merge, and are formed integrally, with a pair of rectangular cover plates 62 and 64, respectively, which slope downwardly and inwardly from the opposite gunwales of side plates 30 and 32 of the boat in the manner illustrated in FIG. 7. It will thus be seen that the vertical triangular plates 58 and 60 form with their respective rectangular inclined plates 62 and 64, a pair of generally triangularly cross-sectioned sealed chambers 66 and 68 which provide spaces for the accommodation of flotation material blocks 70 and 72. The flotation material blocks 70 and 72 are preferably constructed of polystyrene. The particular location and configuration of the flotation chambers 66 and 68 allows room for the clamping bracket of the outboard motor, and for placement of tackle boxes or the like at the stern of the boat, yet provides an arrangement of flotation material at a location such that even trim of the boat in the water is maintained if the boat becomes swamped. The flotation material quantity and location is selectively balanced with that which is located in the bow space or chamber 54. This arrangement, together with a small amount of flotation material which is provided in a space located between side walls 74 and 75 of the inner hull 24 and the side or gunwale walls 30 and 32 of the outer hull, assures that if the boat is swamped or capsized, it will nevertheless float evenly in the water in a partially submerged status. It will thus afford a number of locations where a fisherman dumped into the water can hold onto the floating boat.

Figure 5:
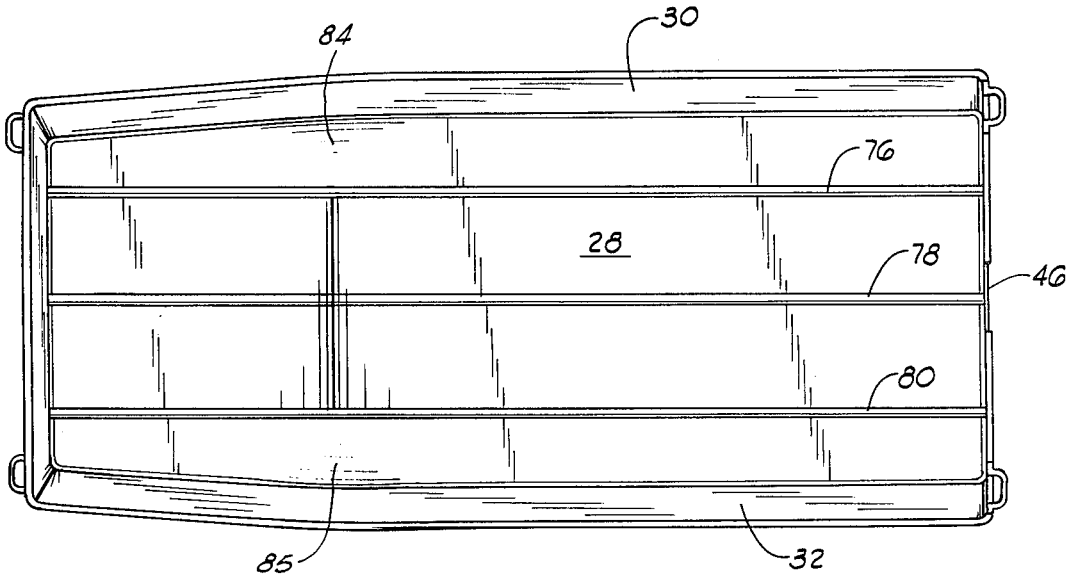
FIG. 5 is a bottom plan view of the boat.
Figure 6:
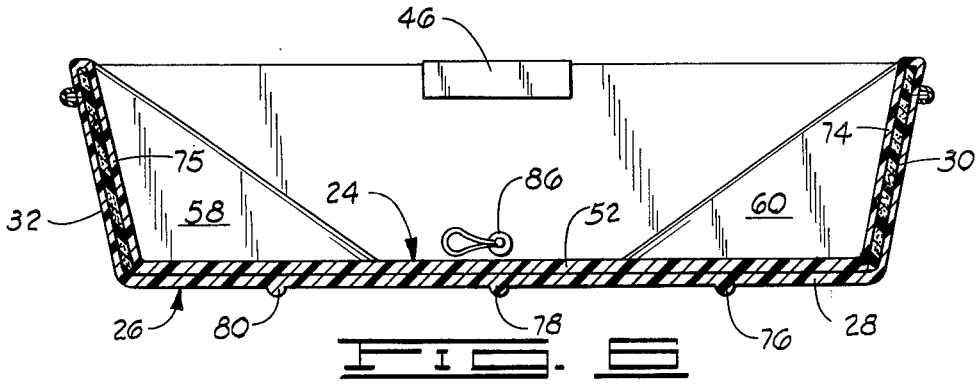
FIG. 6 is a sectional view taken along line 6—6 of FIG. 2.
Figure 10:
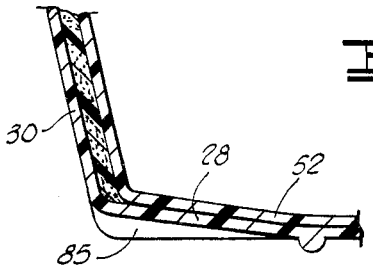
FIG. 10 is a sectional view taken along line 10—10 of FIG. 2.

It will be noted that the bottom panels 52 and 28 of the inner hull 24 and outer hull 26, respectively, are superimposed upon each other so that the bottom may be said to be of double strength and highly reinforced. To provide further reinforcement and to also impart substantial roll stability to the boat, three substantially parallel protuberant ribs 76, 78 and 80 are extended along the bottom side of the outer hull 26 from the stern of the boat to the bow thereof. Further stability is imparted to the boat by a pair of opposed, shallow cavities or recesses 84 and 85 which project from opposite sides of the boat toward the centerline thereof along the underside of the outer hull 26 as shown in FIGS. 5 and 10 of the drawings.

In order to mount the pair of seats 16 and 18 in spaced relation along the centerline of the boat, the pair of frustopyramidally shaped pedestals 20 are provided at spaced locations on the centerline, and are secured at their relatively large base to the upper side of the bottom 52 of the inner hull 24. The seats 16 and 18 are swivelly mounted on the upper side of each of the pedestals 20. It will be perceived that the seat 16 is located relatively near to the inclined ramp plate 50 near the bow 10 of the boat so that a fisherman seated in the forward seat can rest his feet on the inclined ramp plate.

A plug 86 which removably closes a hole 87 extending through the stern transom plate 36 of the boat is provided to permit the boat to be drained of any water which may be inside the boat as a result of rainfall, or due to shipping water during use, so that the interior of the boat will be dry and clean during its usage.

Although a preferred embodiment of the invention has been herein described, it will be understood that various changes and innovations in the illustrated and described structure can be effected without departure from the basic principles which underlie the invention. Changes and innovations of this type are therefore deemed to be circumscribed by the spirit and scope of the present invention, except as the same may be necessarily limited by the appended claims or reasonable equivalents thereof.

What is claimed is:

1. A boat having a bow, a stern, a port side and a starboard side, and further including:

an outer hull having a trapezoidal transverse cross-section and having a bottom;

an inner hull spaced from the outer hull at opposite sides of the boat to define lateral spaces along each of the gunwales of the boat, said inner hull having:

a forward first portion inclined downwardly and extending rearwardly from the bow of the boat and spaced upwardly from the outer hull to define therewith a forward flotation chamber, and to also form an inclined ramp;

a pair of transversely spaced rear second portions adjacent the stern of the boat and spaced upwardly from the outer hull to define a pair of after flotation chambers, said second portions inclining downwardly and inwardly from the respective gunwales at opposite sides of the boat to a location adjacent the outer hull bottom and spaced from the fore and aft centerline of the boat; and an inner hull bottom portion superimposed on, and contacting, the bottom of the outer hull;

flotation material disposed in said lateral spaces, forward flotation chamber and spaced, after flotation chambers to facilitate even and trimmed flotation of the boat in the water when completely swamped; and a seat swivelly disposed in said boat immediately aft of said forward flotation chamber and facilitating resting of the feet of a fisherman seated in said seat upon said inclined ramp.

2. A boat as defined in claim 1 and further characterized as including a seat in said boat abaft said first mentioned seat and located on the centerline of the boat and forward of said after flotation chambers.

3. A boat as defined in claim 1 and further characterized as including a plurality of elongated, transversely spaced keel ribs protruding from the outer side of the bottom of the outer hull and extending from the stern of the boat to the bow thereof; and a pair of stationary recesses indented in the bottom of said outer hull and projecting from opposite sides of the boat toward the centerline of the boat at a location spaced aft of the bow.

4. A boat as defined in claim 1 wherein said inner and outer hulls are fiber glass and said flotation material is foamed polystyrene.

5. A boat as defined in claim 1 and further characterized as including a bow transom plate extending transversely from one side of the boat to the other at the bow of the boat and forming the forward wall of said forward flotation chamber.

6. A boat as defined in claim 1 and further characterized as including:

a stern transom plate extending transversely from one side of the boat to the other at the stern of the boat and forming the rear wall of said two stern flotation chambers; and a motor mounting plate extending over the top edge of said stern transom plate at a location between said stern flotation chambers.

7. A boat as defined in claim 6 and further characterized as including a second seat in said boat abaft said first seat and on the centerline of the boat and forward of said stern flotation chambers.

8. A boat as defined in claim 6 and further characterized as including:

a plurality of elongated, transversely spaced keel ribs projecting from the outer side of the bottom of the outer hull and extending from the stern of the boat to the bow thereof; and a pair of stationary recesses indented in the bottom of said outer hull and projecting from opposite sides of the boat toward the centerline of the boat at a location spaced aft of the bow.

9. A boat as defined in claim 6 and further characterized as including a bow transom plate extending transversely from one side of the boat to the other at the bow of the boat and forming the forward wall of said forward flotation chamber.

10. A boat as defined in claim 9 and further characterized as including:

a plurality of elongated, transversely spaced keel ribs protruding from the outer side of the bottom of the outer hull and extending from the stern of the boat to the bow thereof; and a pair of stationary recesses indented in the bottom of said outer hull and projecting from opposite sides of the boat toward the centerline of the boat at a location spaced aft of the bow.

11. A boat having a bow, a stern, a port side and a starboard side, and further including:

an outer hull having a trapezoidal transverse cross-sectional configuration, and having a bottom interconnecting two upwardly and outwardly extending gunwale side walls;

an inner hull located generally within said outer hull and including a bottom portion superimposed on a portion of the bottom of said outer hull, said inner hull further including a forward inclined ramp plate portion spaced above the bottom of said outer hull and defining, at the bow of the boat, a flotation material space for the accommodation of a buoyant flotation material, said inner hull further including an additional portion adjacent the stern of the boat and spaced upwardly from the bottom of the outer hull, said additional portion defining at least one buoyant material flotation chamber;

buoyant flotation material in said flotation material space and in said flotation chambers;

a first seat swivelly disposed in said boat immediately aft of the said flotation material space and facilitating resting of the feet of a fisherman seated in said first seat upon said inclined ramp;

a second seat swivelly mounted in said boat abaft said first-mentioned seat and located on the centerline of the boat;

a plurality of elongated, transversely spaced keel ribs on the outer side of the bottom of the outer hull and extending from the stern of the boat toward the bow thereof; and a pair of stationary recesses indented in the bottom of said outer hull and projecting from opposite sides of the boat toward the centerline of the boat at a location spaced aft of the bow.

12. A boat as defined in claim 11 wherein said inner and outer hulls are fiber glass and said flotation material is foamed polystyrene.

* * * * *